US005426409A

United States Patent [19]

Johnson

[11] Patent Number: 5,426,409

[45] Date of Patent: Jun. 20, 1995

[54] CURRENT CONTROLLED VARIABLE INDUCTOR

[75] Inventor: Leopold J. Johnson, Valley Center, Calif.

[73] Assignee: The United States of America as represented by the Secretary of the Navy, Washington, D.C.

[21] Appl. No.: 250,135

[22] Filed: May 24, 1994

[51] Int. Cl.[6] ..... H01F 17/02; H01F 3/14

[52] U.S. Cl. ..... 336/178; 336/170; 336/233; 336/155

[58] Field of Search ..... 336/170, 178 O, 233, 336/155, 160, 165

[56] References Cited

U.S. PATENT DOCUMENTS

| | | | |
|---|---|---|---|
| 2,440,984 | 5/1948 | Summers | 175/183 |
| 3,231,841 | 1/1966 | Ohtake | 336/165 |
| 3,419,837 | 12/1968 | Marshall | 336/212 |
| 3,735,305 | 5/1973 | Sinnott et al. | 336/110 |
| 4,160,966 | 7/1979 | Kennedy | 336/155 |
| 4,393,157 | 7/1983 | Roberge et al. | 323/355 |
| 4,447,795 | 5/1984 | Sefko et al. | 336/178 |
| 4,531,108 | 6/1985 | Brandes | 336/5 |
| 4,620,144 | 10/1986 | Bolduc | 323/331 |
| 4,766,365 | 8/1988 | Bolduc et al. | 323/308 |
| 4,874,990 | 10/1989 | Dobnick | 315/276 |

*Primary Examiner*—Leo P. Picard
*Assistant Examiner*—L. Thomas
*Attorney, Agent, or Firm*—Harvey Fendelman; Michael A. Kagan; Eric James Whitesell

[57] ABSTRACT

A current controlled variable inductor comprises a magnetically saturable "EE" core having outer limbs each joined to a center limb by connecting limbs. A staggered series of flux bridges and air gaps are formed into alternating sides of the outer limbs. A bias winding on the center limb magnetically couples a direct current into the core to vary the inductance of a signal winding on the outer limbs. A secondary winding magnetically couples an output voltage from the core for application of the inductor as a tunable transformer.

7 Claims, 2 Drawing Sheets

CURRENT CONTROLLED VARIABLE INDUCTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention is directed to a current controlled, linearly variable inductor. More specifically, the present invention relates to a magnetically saturating inductor having a variable inductance controlled by the application of a direct current.

Currently known inductors, transformers, and reactors incorporating magnetically saturable cores have several disadvantages. These disadvantages include a low inductive energy density relative to the core size, a low range of tunable inductance relative to the bias control current required, high core losses relative to the amount of energy stored, non-linear response, and a narrow range of operating frequencies. The high core losses also cause corresponding distortion of applied voltage waveforms.

An example of saturable core reactor construction is described in U.S. Pat. No. 4,766,365, which teaches a "EE" or three-limbed magnetically saturable core having air gaps on two outer limbs. In this configuration, magnetic energy may flow either through the core material or across the air gaps. Energy loss occurs in the core material in proportion to the flux energy that is converted to heat, and also in proportion to the flux energy that is coupled to conductors outside the core due to fringing of the flux across the air gaps. Unless otherwise noted, all references to flux mean magnetic flux. Fringing may be reduced by enlarging the cross section of the limbs in relation to the width of the air gaps, but this approach further increases the size and weight of the core.

In view of the disadvantages noted above, a need exists for a magnetically saturable inductor having a higher inductive energy density relative to the core size, a higher range of tunable inductance relative to the bias control current required, lower core losses relative to the amount of energy stored, a linear response, and a wider range of operating frequencies.

SUMMARY OF THE INVENTION

A current controlled variable inductor comprises a magnetically saturable "EE" core having outer limbs each joined to a center limb by connecting limbs. A staggered series of flux bridges and air gaps are formed into alternating sides of the outer limbs. A bias winding on the center limb magnetically couples a direct current into the core to vary the inductance of a signal winding on the outer limbs. A secondary winding magnetically couples an output voltage from the core for application of the inductor as a tunable transformer.

One advantage of the present invention is the reduction of magnetic energy losses due to fringing.

Another advantage is that a wide variation in inductance may be controlled with a relatively small bias current.

A further advantage is that a high amount of magnetic energy is stored relative to the core volume, reducing the core size required.

An additional advantage is that inductors of the present invention may be manufactured over a wide range of signal power, frequency, and tunable inductance.

Another advantage is low distortion of the applied voltage waveform.

A further advantage is a linear inductance swing in response to an applied signal.

The presently preferred embodiment of the current controlled variable inductor described below does not preclude other embodiments and advantages that may exist or become obvious to those skilled in the art, and is but one representative embodiment of the present invention.

The features and advantages summarized above in addition to other aspects of the present invention will become more apparent from the description, presented in conjunction with the following drawings.

DESCRIPTION OF THE INVENTION

The following description presents the best mode currently contemplated for practicing the present invention. This description is not to be taken in a limiting sense, but is presented solely for the purpose of disclosing how the present invention may be made and used. The scope of the invention should be determined with reference to the claims.

Figure 1:
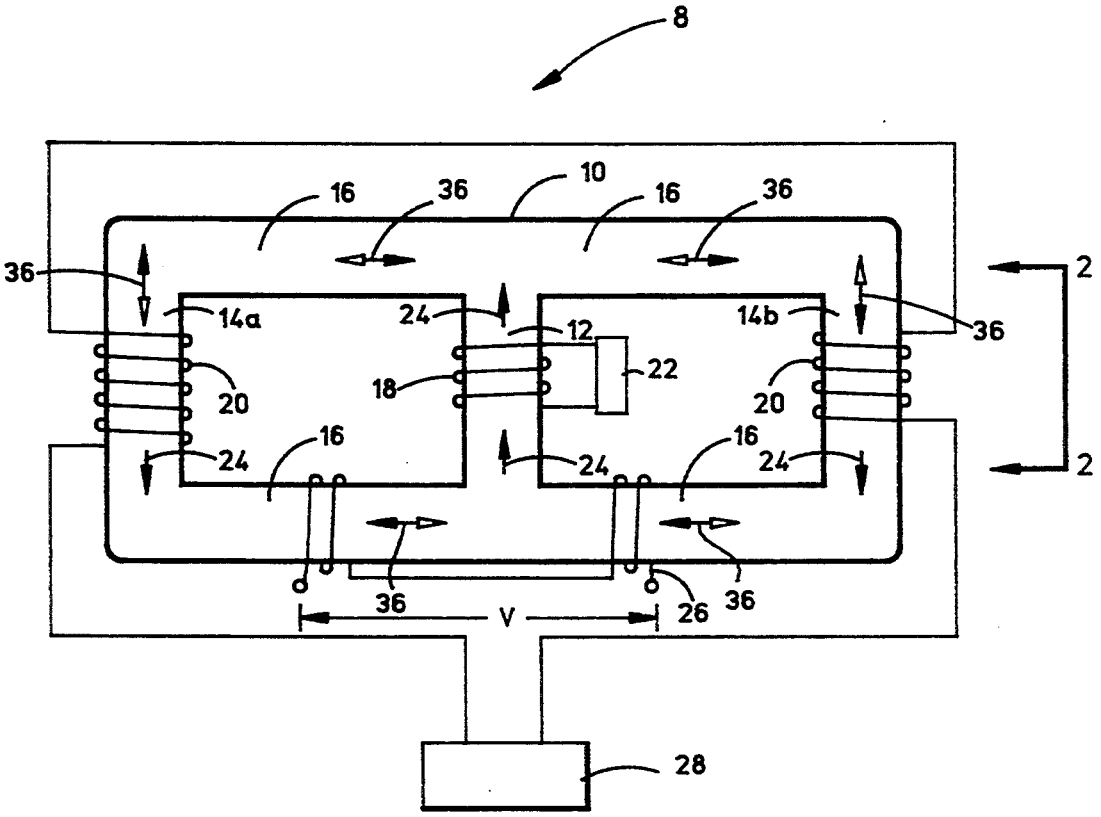
FIG. 1 is a front view of a current controlled variable inductor embodying the various features of the present invention.

In FIG. 1, a current controlled variable inductor 8 comprises a "EE" shaped magnetically saturable core 10 having opposed outer limbs 14*a* and 14*b* joined to a center limb 12 by connecting limbs 16. Outer limbs 14*a* and 14*b* are referred to collectively as outer limbs 14. Outer limbs 14, center limb 12, and connecting limbs 16 preferably have a rectangular cross section, but other cross section shapes may also be used. A bias winding 18 is wound on center limb 12, and a signal winding 20 is preferably woundon outer limbs 14. Core 10 may be made from a solid material, such as ferrite, or tape wound from a highly permeable material such as PERMALLOY. The wire used for bias winding 18 and signal winding 20 may be insulated copper with respective cross sections of preferably at least 300 circular mils per ampere of peak current conducted. Bias winding 18 and signal winding 20 may be wound on bobbins (not shown) and inserted onto core 10 for ease of winding. A secondary winding 26 may be wound, for example, on connecting limbs 16 to form a tunable transformer.

A variable direct current source 22 connected to bias winding 18 induces a bias flux 24 through center limb 12 and connecting limbs 16 to outer limbs 14.

A signal source 28 connected to signal winding 20 induces a signal flux 36 in core 10 in alternating opposite directions through outer limbs 16 and connecting limbs 14, with substantially no net signal flux flowing through center limb 12.

Direct current source 22 may be implemented as, for example, a variable resistor in series with a battery. Signal source 28 may be implemented as an audio frequency generator in series with a resistor.

Figure 2:
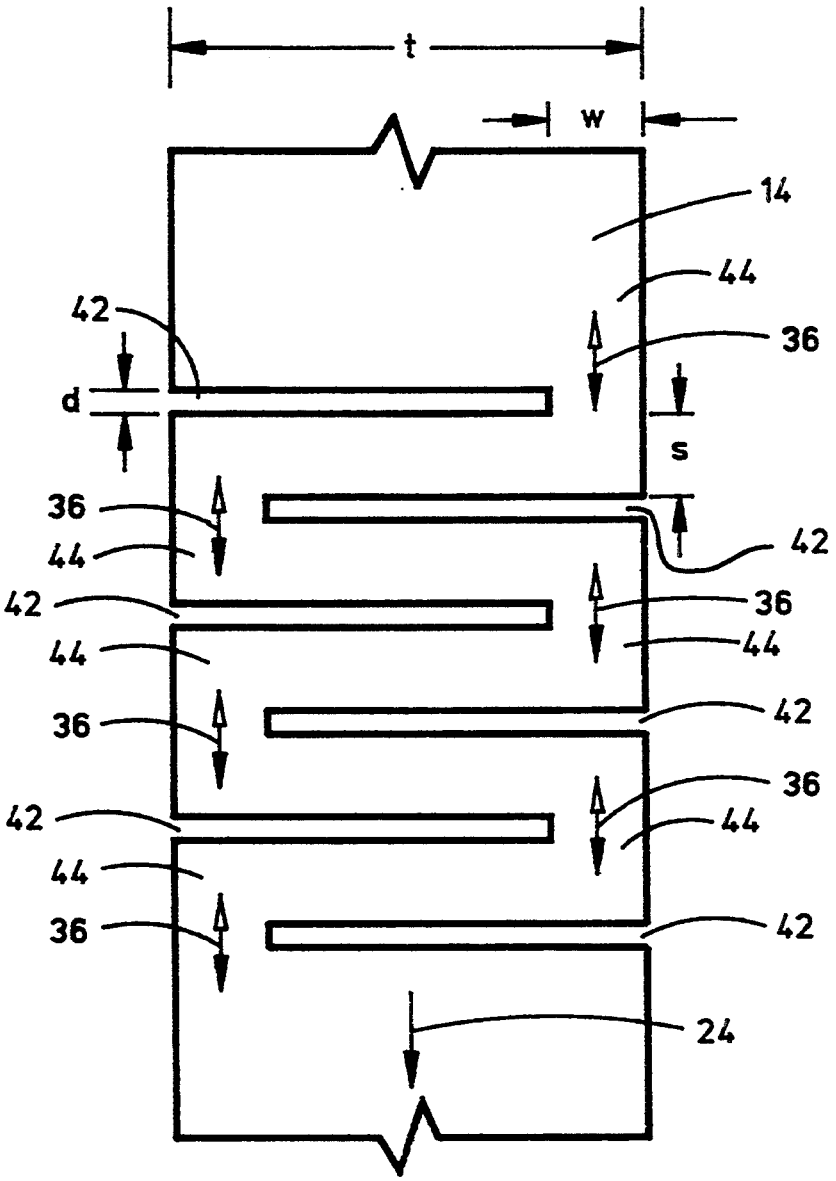
FIG. 2 is a side view of a section of an outer limb of the inductor illustrating the arrangement of serially spaced air gaps and flux bridges.

Referring to FIGS. 1 and 2, a staggered series of air gaps 42 spanned by flux bridges 44 are formed preferably on equally spaced intervals along the length of outer limbs 14 on planes parallel to the cross section of outer limbs 14. To more clearly distinguish the features of the present invention, air gaps 42 and flux bridges 44 are not shown in FIG. 1, and signal winding 20 is not shown in FIG. 2. Air gaps 42 preferably have a common uniform gap distance "d" less than one tenth of the thickness "t" of outer limbs 14, a common width "w" defining the cross section of flux bridges 44, and a common spacing "s" of preferably at least five gap distances. An important feature of the present invention is that air gaps 42 and flux bridges 44 may be incorporated into other magnetically permeable core structures with different sizes, shapes, and cross sections. Magnetic coupling means other than bias winding 18, signal winding 20, and secondary winding 26 may also be used.

In the operation of inductor 8, signal flux 36 generated by signal source 28 preferably peaks just below the saturation point of flux bridges 44 when bias flux 24 has a value of zero. If signal flux 36 exceeds the saturation point of flux bridges 44, the range over which the inductance may be varied is reduced. Preferably the inductance may be varied from a maximum value at just below saturation of flux bridges 44 to a minimum value at full saturation of flux bridges 44 by bias flux 24 generated by variable direct current source 22.

As bias flux 24 is increased, flux bridges 44 saturate during each cycle peak of signal flux 36 that coincides in phase with bias flux 24 in one of outer limbs 14*a* or 14*b*. The portion of signal flux 36 in excess of the saturation point of flux bridges 44 is stored in air gaps 42. The lower permeability of air relative to core 10 reduces the average inductance of signal winding 20 in proportion to the change in reluctance due to bias flux 24 induced by direct current source 22. To realize the full variation in inductance, bias flux 24 from direct current source 22 is increased sufficiently to saturate flux bridges 44 when signal flux 36 has a value of zero. Nearly all of signal flux 36 is then stored in air gaps 42, and the inductance of signal winding 20 reaches a minimum. An important feature of inductor 8 is that the saturated portion of core 10 is limited to the volume defined by flux bridges 44, therefore the heating and power losses of flux bridges 44 are substantially less than the losses of a fully saturated core. Under these favorable operating conditions, the distortion of the voltage waveform of signal winding 20 caused by core power losses is likewise reduced. Also, correspondingly less bias current from direct current source 22 is required to vary the inductance over a selected range than would be required to saturate the entire cross section of outer limbs 14.

The range of inductance of signal winding 20 may be increased without increasing the cross section of outer limbs 14 by increasing the number of flux bridges 44 and air gaps 42 along the length of outer limbs 14. The alternating arrangement of flux bridges 44 guides signal flux 20 over the cross section of outer limbs 14 between air gaps 42. Inductor 8 advantageously incorporates a series of narrow air gaps 42 each having a gap distance "d" to minimize fringing and to define a flux storage volume equivalent to a single air gap having a greater gap distance. The ratio of reactive impedance to resistive impedance, or "Q" is maintained as a higher percentage of flux energy is stored in air gaps 42, because air gaps 42 dissipate no power in contrast to flux bridges 44, offsetting the effect of decreasing inductance with the constant winding resistance of signal winding 20. In applications of inductor 8 as a tunable transformer, secondary winding 26 generates an output voltage "V".

The arrangement of flux bridges 44 and air gaps 42 may be used with core materials spanning frequency ranges from the low audio range to VHF and beyond.

Other modifications, variations, and applications of the present invention may be made in accordance with the above teachings other than as specifically described to practice the invention within the scope of the following claims.

I claim:

1. A current controlled variable inductor, comprising:

a magnetically saturable core further comprising opposed outer limbs having a substantially uniform cross section each joined to a center limb by connecting limbs, wherein a staggered: series of flux bridges and air gaps are formed on spaced intervals along the outer limbs;

an electrically conductive insulated bias winding wound on the center limb for magnetically coupling a bias current to vary the inductance of the inductor; and an electrically conductive insulated signal winding wound on the outer limbs for magnetically coupling a signal current to the inductor.

2. The inductor of claim 1, wherein:

the air gaps have a substantially uniform and equal gap distance, a substantially equal depth in a plane parallel to the cross section of the outer limbs, and an equal spacing along the length of the outer limbs.

3. The inductor of claim 2, further comprising a secondary winding around the connecting limbs for application of the inductor as a tunable transformer.

4. A current controlled variable inductor, comprising:

a magnetically saturable core having a a pair of substantially parallel opposite sidewalls;

a plurality of air gaps formed in the core spaced along the sidewalls, extending horizontally through the core from each sidewall towards the opposite sidewall such that the air gaps are horizontally interlaced;

a plurality of horizontally interlaced core sections defined by the air gaps;.

a plurality of flux bridges defined by vertical core sections between the air gaps and the sidewalls, serially coupled to the horizontal core sections;

means for magnetically coupling a signal current into the core; and means for magnetically coupling a bias current into the core to vary the inductance of the inductor.

5. The inductor of claim 4, further comprising means for magnetically coupling an output voltage from the core to configure the inductor as a tunable transformer.

6. A current controlled variable inductor, comprising:

a magnetically saturable core comprising opposed outer limbs each joined to a center limb by connecting limbs;

a series of interlaced flux gaps formed in opposite sides of the outer limbs defining horizontally interlaced sections of the core;

an arrangement of flux bridges defined by the flux gaps and the opposite sides to operably couple the horizontally interlaced sections of the core in series;

an electrically conductive bias winding wound around the center limb for magnetically coupling a bias current to vary the inductance of the inductor; and an electrically conductive signal winding wound on the outer limbs for magnetically coupling a signal current to the inductor.

7. The inductor of claim 6, further comprising:

a bias current source operably coupled to the bias winding; and a signal source operably coupled to the signal winding.

* * * * *